US008159157B1

(12) United States Patent
Imholt

(10) Patent No.: US 8,159,157 B1
(45) Date of Patent: Apr. 17, 2012

(54) NANOTUBES AS LINEAR ACCELERATORS

(75) Inventor: Timothy J. Imholt, Richardson, TX (US)

(73) Assignee: Raytheon Company, Waltham, MA (US)

( * ) Notice: Subject to any disclaimer, the term of this patent is extended or adjusted under 35 U.S.C. 154(b) by 685 days.

(21) Appl. No.: 12/326,271

(22) Filed: Dec. 2, 2008

Related U.S. Application Data

(60) Provisional application No. 60/991,967, filed on Dec. 3, 2007.

(51) Int. Cl.
*H01J 23/00* (2006.01)

(52) U.S. Cl. ..... 315/500; 315/505; 315/506

(58) Field of Classification Search ..... 315/500, 315/501, 505, 506; 250/396 R, 398
See application file for complete search history.

(56) References Cited

U.S. PATENT DOCUMENTS

| | | | | |
|---|---|---|---|---|
| 6,646,382 | B2 | 11/2003 | Tanabe | 315/5 |
| 6,815,688 | B2 * | 11/2004 | Schneiker et al. | 250/396 R |
| 7,355,334 | B2 | 4/2008 | Anazawa et al. | 313/495 |
| 7,456,565 | B2 | 11/2008 | Nomura | 313/497 |
| 7,495,245 | B2 * | 2/2009 | Zani et al. | 250/492.22 |
| 7,521,693 | B2 * | 4/2009 | Ward et al. | 250/423 F |
| 7,557,365 | B2 * | 7/2009 | Gorrell et al. | 250/503.1 |
| 7,584,601 | B2 * | 9/2009 | Metcalfe et al. | 60/202 |
| 2009/0091274 | A1 * | 4/2009 | Bertozzi et al. | 315/504 |

* cited by examiner

*Primary Examiner* — Tung X Le

(57) ABSTRACT

According to certain embodiments, a linear accelerator comprises a nanotube, a particle, and an energy source. The nanotube has a cylindrical shape, and the particle is disposed within the nanotube. The energy source is configured to apply energy to the nanotube to cause the particle to accelerate.

20 Claims, 3 Drawing Sheets

NANOTUBES AS LINEAR ACCELERATORS

RELATED APPLICATIONS

This application claims priority under 35 U.S.C. §119 of provisional application No. 60/991,967 filed Dec. 3, 2007, entitled "Nanotubes as Linear Accelerators."

TECHNICAL FIELD

This present disclosure relates generally to linear accelerators and more particularly to nanotubes as linear accelerators.

BACKGROUND

Particle accelerators have a wide range of uses in various applications and fields such as in research, medicine, and military. Conventional particle accelerators are large and expensive. As a result, conventional particle accelerators are not useful for many offensive and defensive military applications, particularly when mobility is required.

SUMMARY

According to certain embodiments, a linear accelerator comprises a nanotube, a particle, and an energy source. The nanotube has a cylindrical shape, and the particle is disposed within the nanotube. The energy source is configured to apply energy to the nanotube to cause the particle to accelerate.

Various embodiments of the linear accelerator may benefit from numerous advantages. It should be noted that one or more embodiments may benefit from some, none, or all of the advantages discussed below. In particular embodiments, nanotubes are used to accelerate particles. Nanotubes have an extremely small diameter, so particles that travel through a nanotube, bouncing along the sides, may be accelerated to a high frequency. In addition, nanotube linear accelerators may be smaller, less complex, and more efficient, and thus may require less power. Other technical advantages may become readily apparent to one of ordinary skill in the art after review of the following figures, description, and claims.

BRIEF DESCRIPTION OF THE DRAWINGS

For a more complete understanding of the present invention and for further features and advantages thereof, reference is now made to the following description taken in conjunction with the accompanying drawings, in which.

DETAILED DESCRIPTION

Embodiments of the present invention and its advantages are best understood by referring to FIGS. 1 through 5 of the drawings, like numerals being used for like and corresponding parts of the various drawings.

Figure 1:
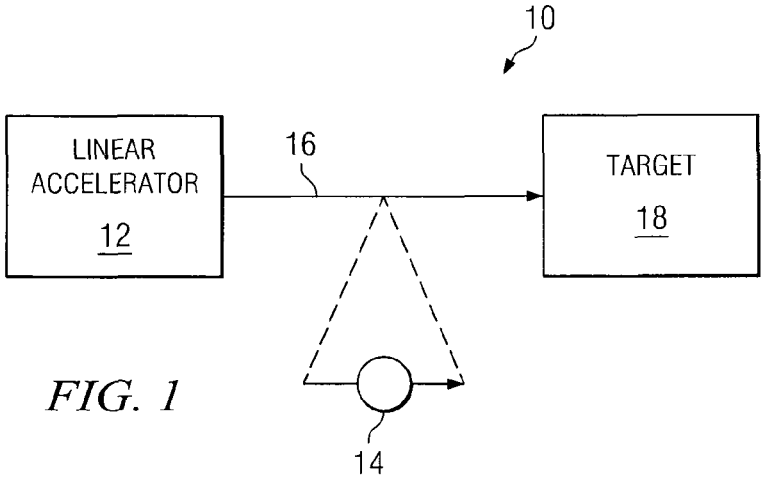
FIG. 1 illustrates a linear accelerator system, according to certain embodiments.

FIG. 1 illustrates a linear accelerator system 10 for accelerating particles according to certain embodiments. Linear accelerator system 10 may have a variety of functions and applications and may be used for any suitable purpose. In particular embodiments, linear accelerator system 10 comprises a linear accelerator 12 that accelerates one or more particles 14 in a particle beam 16 toward a target 18. In particular embodiments, linear accelerator 12 may use nanotubes to accelerate particles. The particles travel through a nanotube, bouncing along the sides, and may be accelerated to a high frequency. Linear accelerator 12 is described in more detail with respect to FIG. 2.

Referring to FIG. 1, according to certain embodiments, particle beam 16 is directed toward target 18. Particle beam 16 comprises one or more particles 14. Particle 14 may be an electron, a proton, or any other appropriate subatomic, atomic, or electrically charged particle. For example, in certain embodiments, particle 14 may be a hydrogen, helium, nitrogen, oxygen, fluorine, neon, chlorine, argon, krypton, xenon, radon, iron, or uranium atom. According to certain embodiments, target 18 may be any area, material, device, or other appropriate target to be affected by particles 14 of particle beam 16.

Linear accelerator system 10 may be used for any appropriate purpose. In certain embodiments, linear accelerator system 10 may be used in offensive weaponry to destroy, damage, detonate, or otherwise alter target 18. Linear accelerator system 10 may also be used in directed energy weapons to disable enemy electronics. In some embodiments, linear accelerator system 10 may be used in material identification systems to identify a material (for example, an explosive material) or composition of target 18. In some embodiments, linear accelerator system 10 may be used in spectroscopy systems to obtain spectroscopic measurements from target 18, in ion implantation systems to implant ions into target 18, in backscattering systems to backscatter particles from target 18, or in nuclear chemistry systems to accelerate particles such that the nuclei interact with target 18.

According to certain embodiments, linear accelerator 12 may be significantly smaller than known linear accelerators. Thus, linear accelerator 12 may be used in applications where small size and/or mobility are important. Additionally, linear accelerator 12 may reduce the costs and/or complexity associated with linear accelerators.

Although FIG. 1 illustrates a particular embodiment that includes particular components that are each configured to provide certain functionality, alternative embodiments may include any appropriate combination of components with the described functionality divided between the components in any suitable manner.

Figure 2:
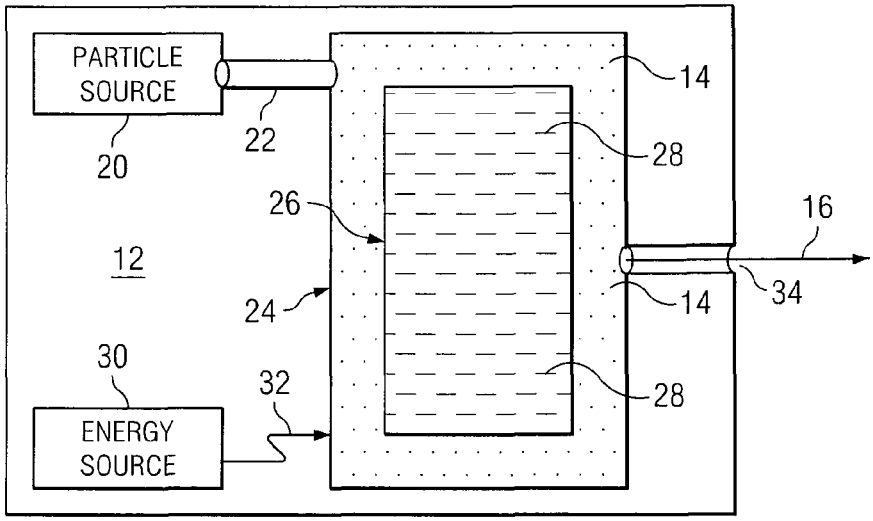
FIG. 2 illustrates a linear accelerator, according to certain embodiments.

FIG. 2 illustrates a linear accelerator 12 according to certain embodiments. In certain embodiments, linear accelerator 12 includes a particle source 20, a nozzle 22, a container 24, a substrate 26 including one or more nanotubes 28, an energy source 30, and an outlet 34. In addition, according to certain embodiments, rather than one linear accelerator, many nanotubes 28 may function together as linear accelerators for multiple particles. The ability to confine multiple particles 14 may make linear accelerator 12 well-suited to applications where bunching of particles may be desirable.

Within linear accelerator 12, particle source 20 may be any suitable particle source for providing any suitable particle 14 to be accelerated. In some embodiments, for example, particle source 20 includes any components suitable to generate subatomic particles (such as electrons or protons) or atomic particles (such as iron particles or uranium particles). The design of particle source 20 may vary depending on the type of particle 14 being accelerated. In certain embodiments, particle source 20 may include a cold cathode, a hot cathode, a photocathode, or a radio frequency ion source.

According to some embodiments, nozzle 22 receives particle 14 from particle source 20 and directs particle 14 to container 24. Nozzle 22 may be any suitable conduit through which particle 14 may be directed to container 24. In some embodiments, the diameter of nozzle 22 may range from 1 to 100 micrometers.

Container 24 may receive particle 14 from nozzle 22. Container 24 may confine particle 14 and substrate 26, including one or more nanotubes 28, within close proximity. Confining particle 14 and nanotubes 28 within close proximity may cause a nanotube 28 to uptake particle 14. Container 24 may be a suitable size to house particles 14 and substrate 26, for example to fit closely around particles 14 and substrate 26.

According to some embodiments, substrate 26 is disposed within container 24 and comprises nanotubes 28 and other constituent materials. In certain embodiments, substrate 26 may include any suitable constituent materials that may be used to accelerate particles 14. For example, planar carbon may be used as a constituent material of substrate 26. Substrate 26 may comprise 1 to 5 percent nanotubes with the constituent materials comprising the remainder of substrate 26.

In particular embodiments, substrate 26 may include one or more nanostructures. A nanostructure has a physical size that, in at least one dimension, is in the range of 0.1 to 100 nanometers. In some embodiments, a nanostructure may exhibit one or more properties that a larger structure, even a larger structure made from the same atomic species, does not exhibit. Nanostructures may have any suitable shape. According to some embodiments, the one or more nanostructures included with substrate 26 may be one or more nanotubes 28. A nanotube 28 may be a cylinder or multiple concentric cylinders.

A nanotube 28 may comprise various materials. In some embodiments, nanotube 28 is synthesized from inorganic materials such as, for example, boron nitride, silicon, titanium dioxide, tungsten disulphide, and/or molybdenum disulphide. In other embodiments, nanotube 28 may be made of carbon. Nanotube 28 may be synthesized by any appropriate technique such as, for example, arc discharge, laser ablation, high pressure carbon monoxide (HiPCO), and chemical vapor deposition (CVD). Nanotube 28 may possess various properties such as, for example, energy absorption and electrical conductivity.

Any suitable shape or size may be used for substrate 26. According to some embodiments, the area of substrate 26 may range in size from approximately one centimeter long by one centimeter wide to approximately one foot long by one foot wide. The thickness of substrate 26 may range from 1 to 10 millimeters. It should be understood, however, that the boundaries on either side of this range are not rigid definitions but rather general values.

In certain embodiments, energy 30 may be any suitable energy source configured to apply any suitable energy 32 to nanotubes 28 that may cause particles 14 disposed within nanotubes 28 to accelerate. Energy 32 may be any appropriate energy for ionizing particle 14 and accelerating particle 14 within nanotube 28. In some embodiments, energy source 30 may apply an electric current, such as a direct current. In certain embodiments, energy source 30 may apply electromagnetic radiation (EMR), electromagnetic waves (EMW), or an electromagnetic field (EMF), such as a laser, a microwave, or any suitable electromagnetic field or combination of electromagnetic fields. According to some embodiments, a microwave may be used because the relatively long wavelength of microwaves may reduce the amount of precision required to aim energy 32 toward nanotubes 28. In particular embodiments, an electromagnetic field may accelerate particles 14 to relativistic velocities, resulting in a considerable increase in energy.

According to certain embodiments, linear accelerator 12 may include an outlet 34 configured to allow particle beam 16 comprising accelerated particles 14 to exit linear accelerator 12. The shape of outlet 34 may be a cylinder with a diameter that is approximately ten times larger than the thickness of substrate 26. For example, if the thickness of substrate 26 is 5 millimeters, the diameter of outlet 34 may be approximately 50 millimeters. According to some embodiments, outlet 34 is not electrically charged.

According to certain embodiments, the use of nanotubes 28 in linear accelerator 12 may greatly simplify linear accelerator technology. In particular, the components used can be smaller, fewer, and less expensive than known linear accelerators, while still achieving similar results.

Although FIG. 2 illustrates a particular embodiment that includes particular components that are each configured to provide certain functionality, alternative embodiments may include any appropriate combination of components with the described functionality divided between the components in any suitable manner. For example, in alternative embodiments, particle source 20 may be located outside linear accelerator 12. In some embodiments, linear accelerator 12 may accelerate particles made present in linear accelerator 12 by other appropriate means. As a result linear accelerator 12 might not include any form of particle source 20, nozzle 22, and/or container 24.

Figure 3:
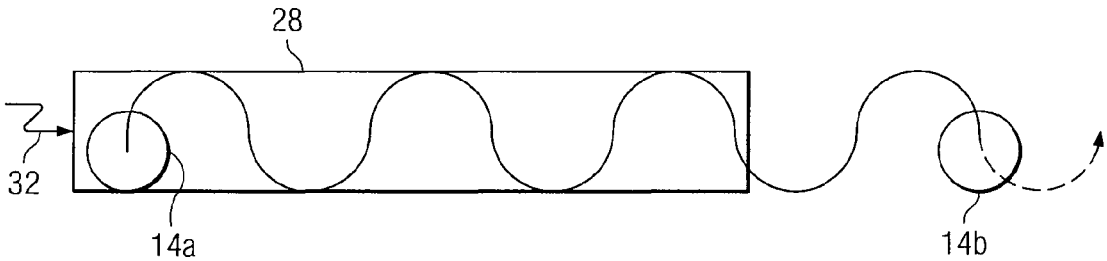
FIG. 3 illustrates a particle accelerated inside of a nanotube, according to certain embodiments.

FIG. 3 illustrates one aspect of linear accelerator 12 according to certain embodiments. Generally, a particle 14*a* is located within nanotube 28. Energy 32, such as EMR, may be applied to nanotube 28 containing particle 14*a*.

Electromagnetic radiation (EMR) may be a self-propagating wave that travels through space and is capable of carrying energy. Waves may be described by physical characteristics such as frequency f and wavelength $\lambda$. Frequency is inversely proportional to wavelength: $c=f\lambda$, where c is the speed of light.

According to the first deBroglie relation, the wavelength $\lambda$ is inversely proportional to the momentum $\rho$ of the particle: $\lambda=h/\rho=h/(\gamma mv)$, where h is Planck's constant, m is the particle's rest mass, v is the particle's velocity, $\gamma$ and is the Lorentz factor. According to the second deBroglie relation, frequency f is directly proportional to particle kinetic energy: $f=E/h=(\gamma mc^2)/h$. Thus, the frequency of a wave is directly related to the total energy. As frequency increases, the energy of the particle increases.

In certain instances, energy 32 applied to nanotube 28 containing particle 14 accelerates particle 14. The diameter of nanotube 28 affects the deBroglie wavelength of particle 14 such that the wavelength is proportional to the diameter of nanotube 28. It follows that the diameter of nanotube 28 affects the total energy and/or frequency of particle 14. The type of energy 32 applied also affects the total energy and/or frequency of particle 14. The combination of the small diameter of nanotube 28 and certain types of energy 32 may result in high total energy, which may be very destructive or lethal.

Although FIG. 3 illustrates a particular embodiment that includes particular components that are each configured to provide certain functionality, alternative embodiments may include any appropriate combination components with the described functionality divided between the components in any suitable manner.

Figure 4:
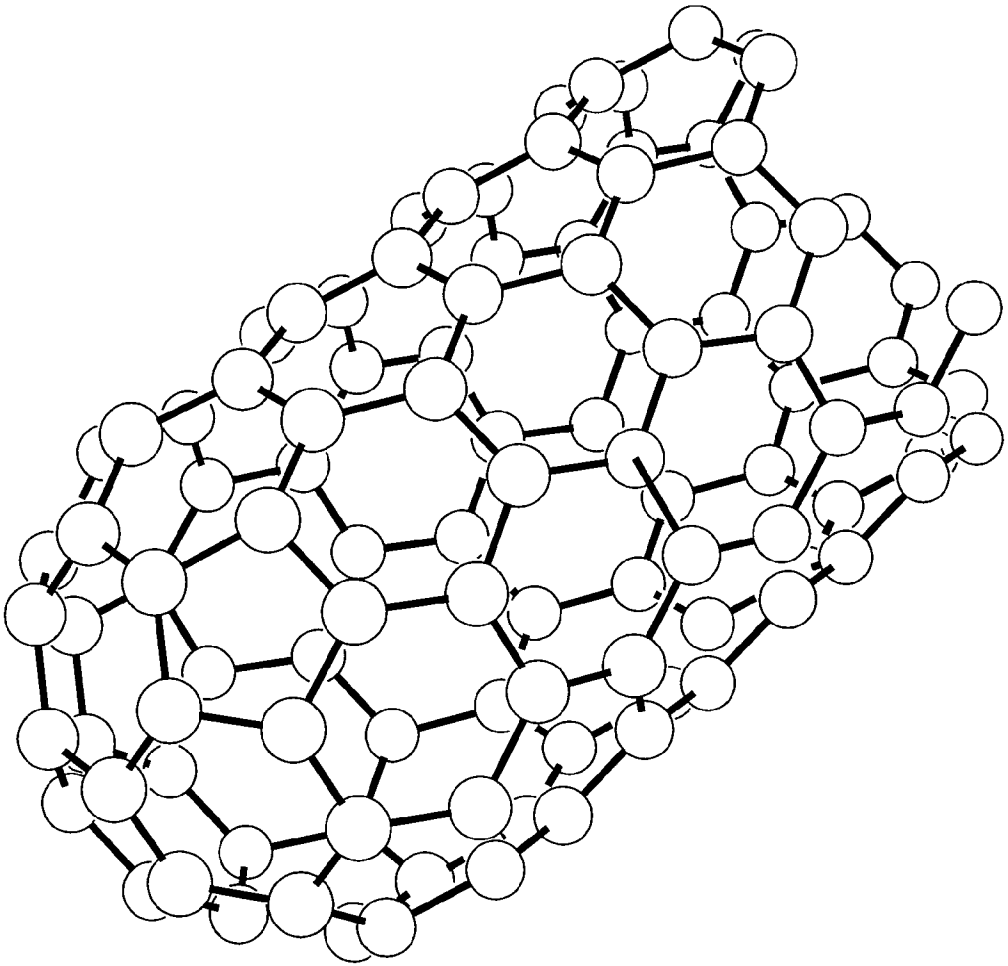
FIG. 4 illustrates an idealization of a single walled nanotube, according to certain embodiments.
Figure 5:
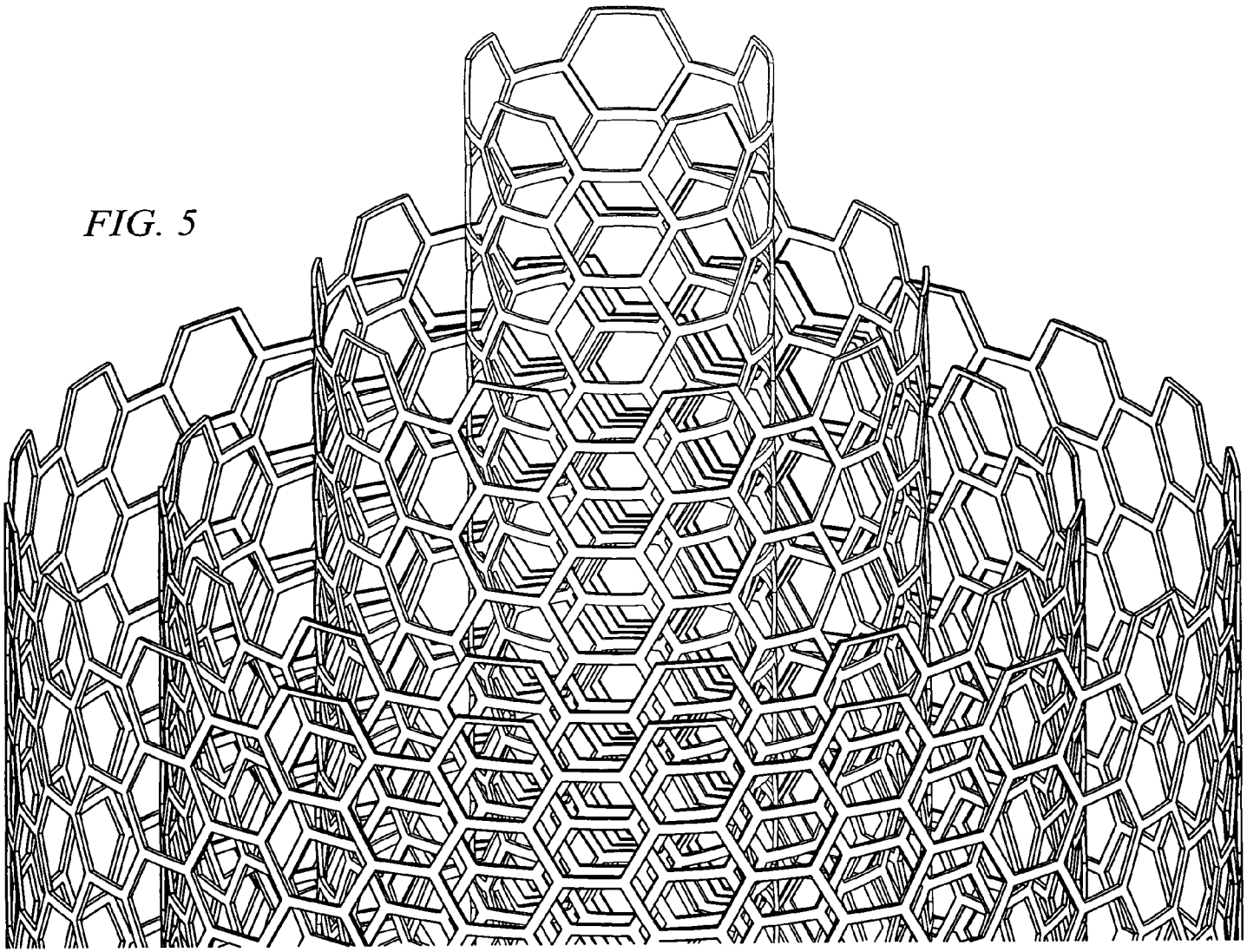
FIG. 5 illustrates an idealization of a multi-walled nanotube, according to certain embodiments.

FIG. 4 and FIG. 5 may be used to illustrate the various properties possessed by nanotubes 28. While FIG. 4 and FIG.

5 discuss carbon nanotubes, it should be understood that any suitable type of nanotube 28, such as an inorganic nanotube, may be used.

A carbon nanotube may be single walled or multi-walled. FIG. 4 illustrates an idealization of a single walled nanotube (SWNT) according to certain embodiments. A SWNT may be a pipe-like structure made of carbon or may comprise a one-atom thick sheet of graphite carbon (referred to as graphene) rolled into a cylinder. The diameter of the cylinder may be generally less than 100 nanometers. In some embodiments, the diameter of the cylinder may be approximately one nanometer. The tube length of a SWNT may be many times longer (e.g., thousands of times longer) than the diameter of the SWNT. Accordingly, a SWNT may have a large aspect ratio (e.g., the length to diameter ratio may exceed 10,000). Although FIG. 4 illustrates a particular embodiment that includes particular components that are each configured to provide certain functionality, alternative embodiments may include any appropriate combination components with the described functionality divided between the components in any suitable manner.

FIG. 5 illustrates an idealization of a multi-walled nanotube (MWNT), according to certain embodiments. A MWNT may be a multiple layered structure of tubes nested within one another. The number of layers in a MWNT may range from two to more than ten. The interlayer distance may be similar to the distance between graphene layers in graphite (e.g., approximately 3.3 angstroms). A MWNT may exhibit electrical conductivity that is similar to that of graphene. In addition, a special category of MWNT referred to as double walled carbon nanotubes (DWNT), comprises two layers of tubes. DWNTs exhibit electrical properties approximate those of SWNTs are significantly more resistant to chemicals. Although FIG. 5 illustrates a particular embodiment that includes particular components that are each configured to provide certain functionality, alternative embodiments may include any appropriate combination components with the described functionality divided between the components in any suitable manner.

Nanotubes 28 may exhibit various properties. For example, nanotubes 28 comprising carbon nanotubes may be strong and stiff. Tensile strengths may be as high as 63 GPa and elastic modulus may be approximately 1 TPa. Additionally, a carbon nanotube may have very low density for a solid material, for example, approximately 1.3 to 1.4 g/cm3. The chemical bonding of atoms in a carbon nanotube may be described by orbital hybridization. In particular, the chemical bonds between carbon atoms in a carbon nanotube may be covalent sp2 bonds, which are generally harder to break than sp3 bonds found in diamonds. This bonding structure contributes to the strength of the carbon nanotube. Further, in some embodiments, nanotube 28 may act as an electrical conductor or semiconductor. In particular embodiments, carbon nanotubes can handle high electric current densities. In particular embodiments, carbon nanotubes may be ballistic thermal conductors along the long axis of the tube and may also be insulators in the lateral direction.

Although the present invention has been described in several embodiments, a myriad of changes and modifications may be suggested to one skilled in the art, and it is intended that the present invention encompass such changes and modifications as fall within the scope of the present appended claims.

What is claimed is:

1. A linear accelerator comprising:

a substrate comprising a plurality of nanotubes and one or more other constituent materials, the plurality of nanotubes comprising 1 to 5 percent of the substrate;

a particle disposed within a nanotube of the plurality of nanotubes, the nanotube having a cylindrical shape; and an energy source configured to apply energy to the nanotube to cause the particle to accelerate.

2. The linear accelerator of claim 1, the particle comprising a particle selected from the group consisting of a proton, an electron, a hydrogen atom, a helium atom, a nitrogen atom, an oxygen atom, a fluorine atom, a neon atom, a chlorine atom, an argon atom, a krypton atom, a xenon atom, a radon atom, an iron atom, or a uranium atom.

3. The linear accelerator of claim 1, the energy source comprising an energy source selected from the group consisting of a laser source, a microwave source, or a direct current source.

4. The linear accelerator of claim 1, the nanotube comprising a nanotube selected from the group of nanotubes consisting of a single walled carbon nanotube, a multi-walled carbon nanotube, a single-walled inorganic nanotube, and a multi-walled inorganic nanotube.

5. The linear accelerator of claim 1, further comprising a particle source configured to provide the particle, the particle source comprising a particle source selected from the group of particle sources consisting of a cold cathode, a hot cathode, a photocathode, or an RF ion source.

6. The linear accelerator of claim 1, further comprising a container configured to surround the nanotube.

7. The linear accelerator of claim 1, the particle accelerated to have a wavelength proportional to a diameter of the nanotube.

8. The linear accelerator of claim 1, further comprising:

the plurality of nanotubes having a cylindrical shape;

a plurality of particles, each particle disposed within a nanotube of the plurality of nanotubes; and the energy source configured to apply the energy to the plurality of nanotubes to cause the plurality of particles to accelerate.

9. The linear accelerator of claim 1, further comprising a nozzle configured to:

receive the particle from a particle source; and direct the particle to a container surrounding the nanotube.

10. The linear accelerator of claim 1, wherein one of the other constituent materials comprises planar carbon.

11. A linear accelerator comprising:

a substrate comprising a plurality of nanotubes and one or more other constituent materials, the plurality of nanotubes comprising 1 to 5 percent of the substrate;

a container configured to surround the substrate;

a nozzle configured to:

receive a particle from a particle source; and direct the particle to the container surrounding the substrate to dispose the particle within a nanotube of the plurality of nanotubes, the nanotube having a cylindrical shape; and an energy source configured to apply energy to the nanotube to cause the particle to accelerate.

12. The linear accelerator of claim 11, the particle comprising a particle selected from the group consisting of a proton, an electron, a hydrogen atom, a helium atom, a nitrogen atom, an oxygen atom, a fluorine atom, a neon atom, a chlorine atom, an argon atom, a krypton atom, a xenon atom, a radon atom, an iron atom, or a uranium atom.

13. The linear accelerator of claim 11, the energy source comprising an energy source selected from the group consisting of a laser source, a microwave source, or a direct current source.

14. The linear accelerator of claim 11, the nanotube comprising a nanotube selected from the group of nanotubes consisting of a single walled carbon nanotube, a multi-walled carbon nanotube, a single-walled inorganic nanotube, and a multi-walled inorganic nanotube.

15. The linear accelerator of claim 11, the particle source comprising a particle source selected from the group of particle sources consisting of a cold cathode, a hot cathode, a photocathode, or an RF ion source.

16. The linear accelerator of claim 11, the particle accelerated to have a wavelength proportional to a diameter of the nanotube.

17. The linear accelerator of claim 11, further comprising:

the plurality of nanotubes having a cylindrical shape;

the container configured to surround the plurality of nanotubes;

the nozzle configured to:

receive a plurality of particles from the particle source; and direct the plurality of particles to the container surrounding the plurality of nanotubes to dispose one or more particles of the plurality of particles within at least one nanotube of the plurality of nanotubes; and the energy source configured to apply the energy to the plurality of nanotubes to cause the plurality of particles to accelerate.

18. The linear accelerator of claim 11, wherein one of the other constituent materials comprises planar carbon.

19. A linear accelerator comprising:

a substrate comprising a plurality of nanotubes and one or more other constituent materials, the plurality of nanotubes comprising 1 to 5 percent of the substrate;

a container configured to surround the substrate;

a particle source configured to provide a particle;

a nozzle configured to:

receive the particle from the particle source; and direct the particle to the container surrounding the substrate to dispose the particle within a nanotube of the plurality of nanotubes, the nanotube having a cylindrical shape; and an energy source configured to apply energy to the nanotube to cause the particle to accelerate.

20. The linear accelerator of claim 19, wherein one of the other constituent materials comprises planar carbon.

* * * * *